United States Patent [19]

Hockenberry

[11] Patent Number: 4,826,265

[45] Date of Patent: May 2, 1989

[54] SHELVING SYSTEM FOR MUSICAL INSTRUMENT STORAGE

[75] Inventor: Jack K. Hockenberry, Owatonna, Minn.

[73] Assignee: Wenger Corporation, Owatonna, Minn.

[21] Appl. No.: 74,414

[22] Filed: Jul. 16, 1987

[51] Int. Cl.[4] ..... A47B 88/00

[52] U.S. Cl. ..... 312/326; 292/148; 108/901; 211/153

[58] Field of Search ..... 312/326, 311, 257 SM, 312/350; 292/148; 108/901; 248/248, 903; 211/153, 186, 187; 220/72, 66

[56] References Cited

U.S. PATENT DOCUMENTS

| | | | |
|---|---|---|---|
| 1,041,700 | 10/1912 | Thomley | 292/148 X |
| 2,138,560 | 11/1938 | Stuart | 312/311 X |
| 3,404,642 | 10/1960 | Belcher | 108/901 |
| 3,405,666 | 10/1960 | Miller | 108/901 |
| 3,443,715 | 5/1965 | Edwards | 220/72 X |
| 3,591,213 | 7/1971 | Turner | 248/248 X |
| 3,908,566 | 9/1975 | Frazelle et al. | 108/153 |
| 4,580,818 | 4/1986 | Lyng | 292/148 |

*Primary Examiner*—Joseph Falk

*Attorney, Agent, or Firm*—Dorsey & Whitney

[57] ABSTRACT

A shelving system is provided having an upright frame and specially designed lightweight, high strength shelves. The shelves include strength ribs and grooves formed in a shelf upper surface that are melded to shelf lower surface dimples for strength and rigidity. The shelving system is particularly adapted for storing musical instruments.

10 Claims, 2 Drawing Sheets

SHELVING SYSTEM FOR MUSICAL INSTRUMENT STORAGE

TECHNICAL FIELD

The present invention relates to shelving systems. In particular, it relates to a shelving system incorporating lightweight, high strength, blow molded, synthetic resin shelves, and a unique latching mechanism. The shelving system herein disclosed is particularly suited for storage of musical instruments.

BACKGROUND ART

Musical instruments present several unique storage problems. The instruments are generally fragile and easily damaged, and must therefore be placed in large, rigid cases when not in use. Moreover, even when the instruments are in use, storage of the bulky instrument cases is still required. The problem of case storage is particularly acute in school band rooms where large numbers of students frequently assemble to play their instruments in school bands and orchestras. Additional storage problems are presented by the fact that musical instruments are generally considered high value items that require secure storage. Shelving systems heretofore provided for the storage of musical instruments are not necessarily secure, are difficult to install, and are often damaged by the metal runners and corner guards frequently found on musical instrument cases. In turn, the materials and designs used in conventional shelving systems are often abrasive and destructive to instrument case coverings, metal runners, corner guards and case handles.

SUMMARY OF THE INVENTION

The problems outlined above are in large part solved by the musical storage system in accordance with the present invention. The shelving system hereof includes an upright frame, a lightweight, nonabrasive, high strength, synthetic resin shelf that is easily assembled to the frame, and a unique locking mechanism. The shelves broadly include a top surface having a plurality of back to front strength ribs and grooves, a rounded front edge, and a bottom surface having a plurality of strength providing dimples. The top surface grooves and bottom surface dimples are melded together, providing a lightweight, high strength shelf construction suitable for blow molding from high density polyethylene or any other suitable synthetic resin. Support brackets are carried by the shelf that are easily attached to the upright frame. The latching mechanism hereof broadly includes a carrier bracket, a latching slide shiftably received by the carrier bracket, and a slide engaging boss carried by the bracket that restricts the side to side movement of the slide within the bracket. First and second padlock receiving members on the slide and bracket, respectively, are held spaced apart by the boss at a distance that makes the padlock locking loop inaccessible when he first and second padlock receiving members are secured together by a padlock.

DETAILED DESCRIPTION OF THE DRAWINGS

Figure 1:
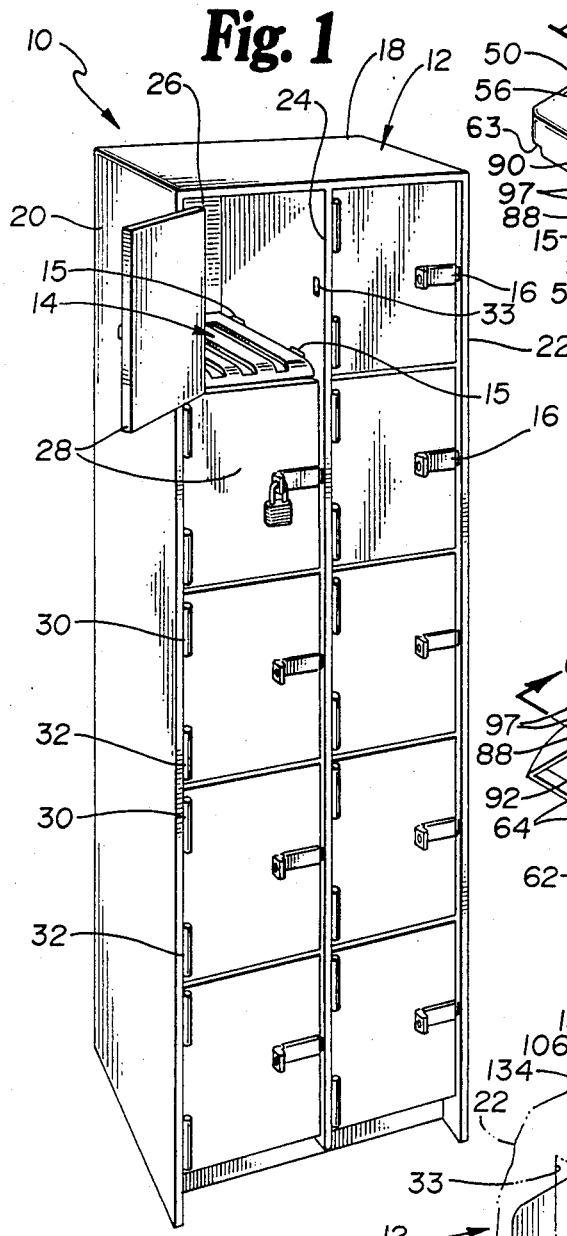
FIG. 1 is a perspective view of a storage system in accordance with the present invention.

Referring to the drawings, a shelving system 10 in accordance with the present invention broadly includes an upright frame 12, removable shelves 14, shelf support brackets 15, and latching mechanism 16.

Frame 12 includes top wall 18, marginal sidewalls 20, 22, internal sidewall 24, backwall 26, and individual compartment doors 28. The doors 28 are swingably attached to respective sidewalls 20, 24 by upper and lower hinges 30, 32. Latch receiving strikes 33 are formed in sidewalls 22, 24.

Each shelf 14 broadly includes a top surface 34, bottom surface 36, front edge 38, rear edge 40, and opposed side edges 42, 44. The shelves 14 are advantageously formed from a synthetic resin such as high density polyethylene.

Figure 2:
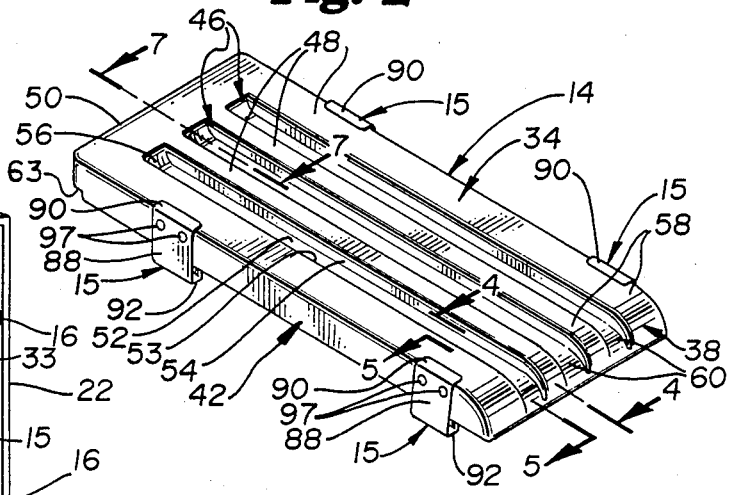
FIG. 2 is a perspective view depicting the top surface of an individual shelf.
Figure 3:
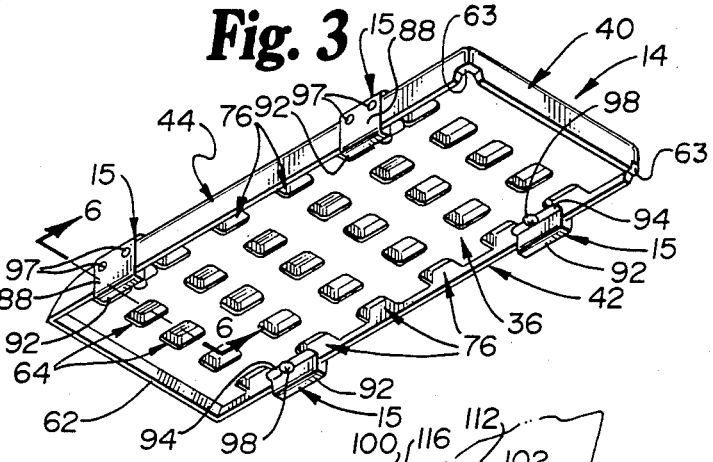
FIG. 3 is a perspective view depicting the bottom surface of an individual shelf.
Figure 8:
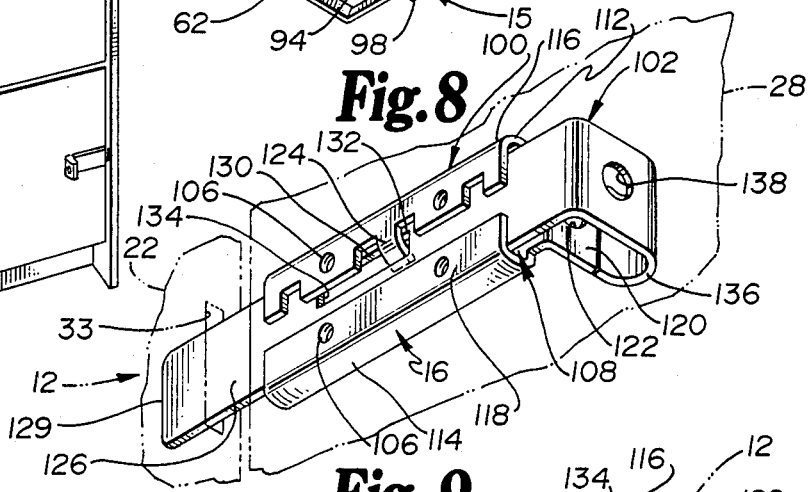
FIG. 8 is a perspective view of the latching mechanism as seen from the inside of a storage compartment, phantom lines depicting the door and compartment sidewall.
Figure 4:
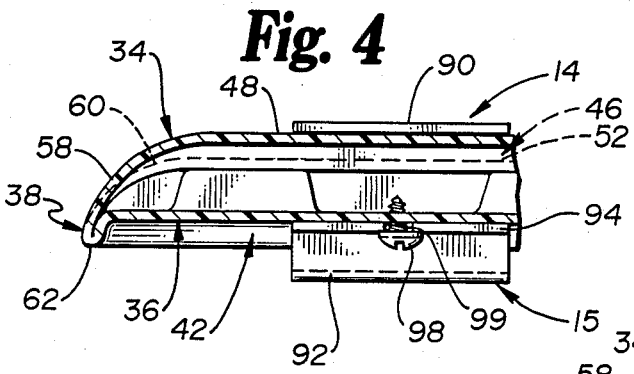
FIG. 4 is a fragmentary, sectional view taken along line 4—4 of FIG. 2.
Figure 5:
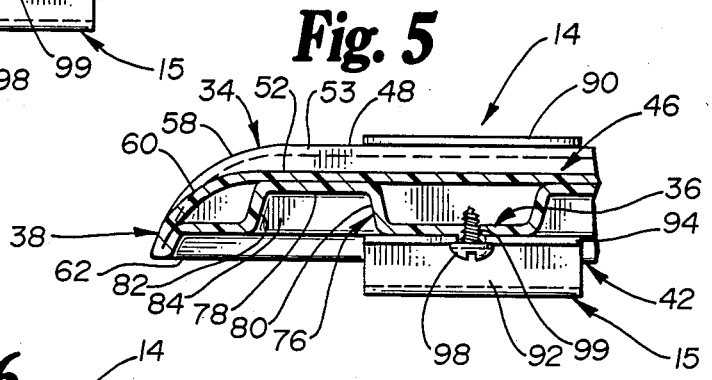
FIG. 5 is fragmentary, sectional view taken along line 5—5 of FIG. 2.
Figure 6:
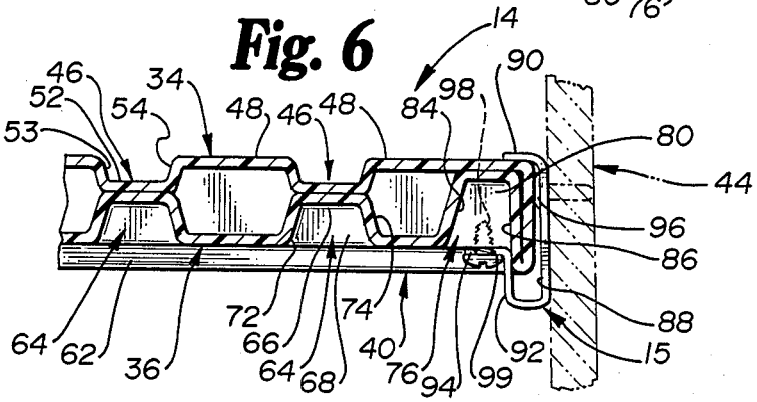
FIG. 6 is a fragmentary, sectional view taken along line 6—6 of FIG. 3.

Top surface 34 includes longitudinal, back to front, parallel grooves 46 that define longitudinal, back to front, parallel ribs 48 and top shelf back portion 50. The ribs 48 and back portion 50 present a generally planar support face. Grooves 46 include groove bottom wall 52, opposed groove sidewalls 53, 54 and inclined groove rearwall 56. As best seen in FIG. 6, the grooves sidewalls 54 are upwardly, outwardly inclined presenting the grooves 46 with an open face. As best depicted in FIGS. 2, 4, and 5, the rib leading edges 58 and groove leading edges 60 are rounded downwardly to present rolled shelf front edge 38. Referring to FIGS. 4 and 5, it will be appreciated that the rib leading edges 58 are rolled at a larger radius than are the groove leading edges 60.

Figure 7:
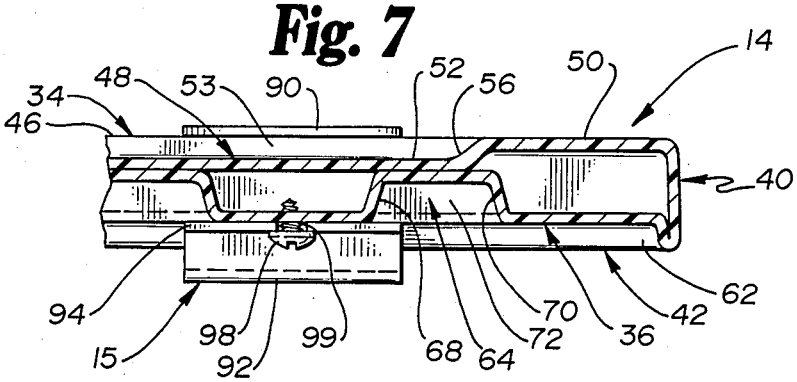
FIG. 7 is a fragmentary, sectional view taken along line 7—7 of FIG. 2.

Bottom surface 36 is raised so as to present lowermost circumferential rim 62. The rim 62 includes a bracket receiving notch 63 at the two corners of rear edge 40. A plurality of generally rectangular dimples 64 are formed in rows and columns on bottom surface 36. Each dimple 64 includes a dimple bottom wall 66, dimple front and back wall 68, 70, and opposed dimple sidewalls 72, 74. The dimple front wall, back wall and sidewalls 68, 70, 72, 74 are inclined downwardly, outwardly so as to present the dimples 64 with generally open faces. The bottom surface 36 also includes marginal recesses 76 similar in construction to the dimples 64. Marginal recesses 76 are oriented along the shelf side edges 42, 44, and include recess bottom wall 78, recess back and front walls 80, 82, and opposed recess sidewalls 84, 86. The recess front wall, back wall and sidewalls 80, 82, 84, 86 are inclined downwardly, outwardly so as to present the recesses 76 with generally open faces. Referring in particular to FIGS. 5, 6 and 7, it will be seen that the dimple bottom walls 66 are melded together with the bottom walls 52 of grooves 46, and that the bottom walls 78 of the marginal recesses 76 are melded together with the outermost ribs 48 adjacent to the shelf side edges 42.

Brackets 15 are slidably received by shelf side edges 42, 44. Each bracket 15 includes side plate 88, top surface engaging upper lip 90, lowermost rib receiving channel 92, and bottom surface engaging flange 94. Attachment elements 96, such as screws or rivets, are received through apertures 97 in side plate 88 and fixedly carried by respective frame sidewalls 20, 22, 24. A screw 98 is received through aperture 99 in flange 94 for securely fastening the bottom surfaces 36 of shelves 14 to respective bracket 15.

Latching mechanism 16 broadly includes carrier bracket 100, and latching slide 102 shiftably received by the carrier bracket 100. An individual carrier bracket 100 is fixedly attached to a respective door 28 by screws 104. The screws 104 extend through door 28, from the inside surface of the door, and are received within threaded channels 106.

Carrier bracket 100 defines a narrow, slide receiving channel 108. The carrier bracket 100 is formed from a stamped and formed metal piece that includes carrier bracket front wall 110, bracket top and bottom walls 112, 114, and a bracket back wall defined by upper half back wall 116 and lower half back wall 118. Bracket padlock receiving member 120 is integral with and extends outwardly and forwardly from bracket front wall 110. Padlock receiving aperture 122 is defined within the padlock receiving member 120. Slide engaging boss 124 is integral with and bent forwardly from the bracket upper half back wall 116.

Figure 9:
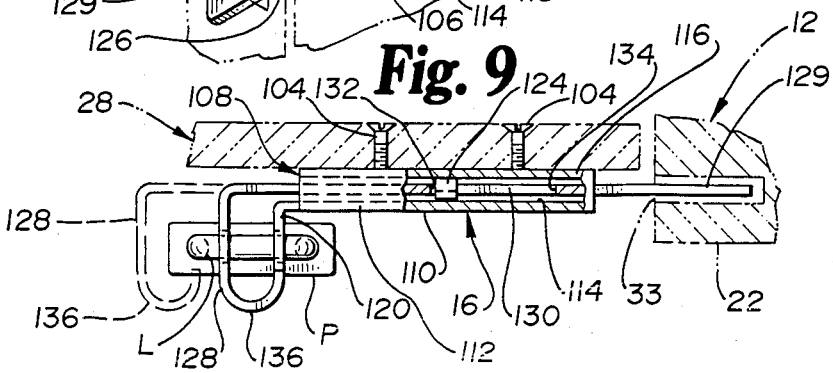
FIG. 9 is a planar view of the latching mechanism as attached to a cabinet door, with parts broken away for clarity, phantom lines depicting the latch slide in its disengaged position.

Slide 102 is a stamped and formed, rigid metal strip having slide portion 126 and padlock receiving portion 128. The terminal end 129 of slide portion 126 is receivable within a respective strike 33. Slide portion 126 includes boss receiving cam aperture 130. The boss receiving cam aperture 130 includes opposed, boss engaging margins 132, 134. Padlock receiving portion 128 of slide 102 extends forwardly from slide portion 126. The end of the slide padlock receiving portion 128 is bent into a curved padlock covering shroud 136 and includes slide padlock receiving aperture 138. As depicted in FIG. 9, the slide 102 is shiftable between a locked position (solid lines) and a disengaged position (phantom lines). The leading edge 140 of shroud 136 aligns with padlock receiving member 120 of bracket 100 when the slide 102 is in the locked position.

In operation, shelves 14 are supported within frame 12 by bracket clips 15, to form individual storage compartments. It will be appreciated that, although the compartments depicted in FIG. 1 are all the same size, the shelves could be positioned at any relative height within frame 12 to provide compartments of any desired size. The brackets 15 are conveniently mounted in frame sidewalls 20, 22, 24 at the desired positions. The frame sidewalls 20, 22, 24 may be provided with preformed screw or rivet receiving channels. Once the brackets 15 are fixedly attached to the sidewalls 20, 22, 24, shelves 14 are slidably inserted into the brackets 15. Notches 63 in rim 62 facilitate the sliding acceptance of the shelves 14 by the brackets 15. Screws 98 are then installed to secure the shelves 14 within frame 12.

The grooves 46 and ribs 48 in shelf top surface 34, together with the dimples 64 and marginal recesses 76 of the shelf bottom surface 36 provide a sturdy, lightweight shelf design. The particular shelf design is particularly adapted to the use of a synthetic resin such as high density polyethylene in forming the shelves 14, thereby providing a nonscratchable, nonabrasive support surface. Moreover, the use of synthetic resin material, together with the spaced apart relationship of top surface 34 and bottom surface 36 provide the shelf 14 with flexibility and the ability to absorb shock. The rolled front edge 38 provides for ease of entry and egress of musical instrument cases, or of any other desired package to be stored, into and out of the individual compartments. The shelf top surface grooves 46 and ribs 48 allow the top surface 34 to act as a strength member, while the front to back orientation of the grooves and ribs 48 allow for free, unobstructed entry and egress of packages from the individual compartments.

The latching mechanism 16 provides for individualized compartment security. Terminal end 129 of slide 102 is received within a respective strike 33 when the slide 102 is in the locked position, preventing door 28 from swinging on its hinges 30, 32. Shifting of the slide 12 to the disengaged position (depicted in phantom lines in FIG. 9) clears the slide terminal end 129 from strike 33, allowing the door 28 to swing freely on its hinges.

The slide engaging boss 124 extending from the back wall of bracket 100 alternately abuts against boss engaging margins 132, 134 of the slide boss receiving cam aperture 130. Engagement of the boss 124 with boss engaging margin 134 prevents the slide 132 from being removed from bracket 100. Engagement of the slide engaging boss 124 with boss engaging margin 132 prevents padlock receiving portion 128 of slide 102 from coming into contact with padlock receiving member 120 of bracket 100. As will be appreciated by reference to FIG. 9, maintaining the spaced apart relationship of padlock receiving portion 128 of slide 102 and padlock receiving member 120 of bracket 100 with a padlock P in place, prevents easy access to the loop L of the padlock P, frustrating attempts to sever the loop L with a bolt cutting device or the like.

The shelving system described herein is particularly suited for the storage of musical instruments. It will be understood, however, that the described storage system is equally well suited for storing items other than musical instruments.

I claim:

1. A lighweight, synthetic resin shelf member for storing articles, said shelf member being adapted for mounting within a generally upright frame, comprising:

a top surface having a front edge portion and a back portion, said top surface including structure defining at least one fore and aft, elongated groove extending from a portion of the top surface rearwardly of said front edge portion to said back portion, said groove having a groove bottom wall and opposed groove sidewalls;

a bottom surface having a face spaced apart from said top surface, and structure defining at least one recess extending inwardly from said bottom surface face, said recess including a recess top wall, recess front wall, and recess rear wall, said recess top wall being melded with said top surface groove bottom wall, whereby the melding of said recess top wall and said groove bottom wall provides strength to said shelf member, and the fore and aft orientation of said groove facilitates entry and egress of articles from said shelf member; and said top surface and said groove bottom wall presenting top surface and groove bottom wall downwardly rounded portions, said groove bottom wall rounded portion being recessed from said top surface rounded portion.

2. The invention as claimed in claim 1, said groove sidewalls being inclined upwardly, outwardly to present a generally open faced groove.

3. The invention as claimed in claim 4, said bottom surface recess being generally rectangular in cross section.

4. The invention as claimed in claim 1, said recess including opposed recess sidewalls, said recess being generally aligned with said top surface groove.

5. The invention as claimed in claim 4, said top surface including structure defining a plurality of grooves, said top surface including opposed side margins, said grooves defining top surface side ribs extending along said side margins, said bottom surface including structure having side margin indents, said indents including an indent top wall, indent front wall and opposed indent sidewalls, said indent top walls being melded with a respective one of said top surface side ribs.

6. A lightweight, sysnthetic resin shelf member for storing articles, said shelf member being adapted for mounting within a generally upright frame, comprising:

a top surface having a leading edge and a back portion, said top surface including structure defining at least one fore and aft, elongated groove extending generally between said leading edge and said back portion, said groove having a groove bottom wall and opposed groove sidewalls; and a bottom surface having a face spaced apart from said top surface, and structure defining at least one recess extending inwardly from said bottom surface face, said recess including a recess top wall, recess front wall, and recess rear wall, said recess top wall being melded with said top surface groove bottom wall, whereby the melding of said recess top wall and said groove bottom wall provides strength to said shelf member, and the fore anf aft orientation of said groove facilitates entry and egress of articles from said shelf member;

said shelf member including a downwardly extending peripheral rim extending generally around said bottom surface adapted for receiving a retaining bracket for mounting of said shelf member within said generally upright frame.

7. A latching mechanism, comprising:

a carrier bracket defining an internal, latch slide receiving channel, said bracket having a front wall, and a back wall, said back wall including a latch slide engaging boss extending inwardly from said back wall into said channel, said front wall including an outwardly extending bracket tab having structure defining a padlock receiving aperture; and a latch slide shiftably carried by said carrier bracket and received within said channel, said latch slide including structure defining a boss receiving aperture having first and second opposed margins, said boss being received through said aperture and said slide shiftable between a locked position wherein said boss engages said first margin, and a clearing position wherein said boss engages said second margin, said slide further including an outwardly extending slide tab aligned with said bracket tab and having structure defining a padlock aperture therein, said bracket tab and said slide tab being spaced apart from each other when said slide is in said locked position to present a gap therebetween, said slide tab including a shroud member extending generally across said gap.

8. A storage system, comprising:

a frame;

a shelf member adapted for mounting within said frame, said shelf member comprising:

a top surface having a leading edge and a back portion, said top surface including structure defining a plurality of fore and aft, elongated grooves extending generally between said leading edge and said back portion, said grooves having a groove bottom wall, and opposed groove sidewalls; and a bottom surface having a generally planar face spaced apart from said top surface, and structure defining a plurality of recesses extending inwardly from said bottom surface planar face and being generally aligned with said top surface grooves, said recesses including a recess top wall, recess front wall, recess rear wall and opposed recess sidewalls, said recess top walls being melded with a respective one of said top surface groove bottom walls, whereby the melding of said recess top walls and said groove bottom walls provides strength to said shelf member, and the fore and aft orientation of said grooves facilitates entry and egress of articles from said shelf member;

a door panel hingeably coupled to said frame; and a latching mechanism carried by said door panel, said latching mechanism operably, shiftably receivable by said frame for locking said door panel, said latching mechanism including:

a carrier bracket defining an internal, latch slide receiving channel, said bracket having a generally solid front wall, and a back wall, said back wall including a latch slide engaging boss extending inwardly from said back wall into said channel, said front wall including an outwardly extending bracket tab having structure defining a padlock receiving aperture; and a latch slide shiftably carried by said carrier bracket and received within said channel, said latch slide including structure defining a boss receiving aperture having first and second opposed margins, said boss being received through said aperture and said slide shiftable between a locked position wherein said boss engages said first margin, and a clearing position wherein said boss engages said second margin, said slide further including an outwardly extending slide tab aligned with said bracket tab and having structure defining a padlock aperture therein, said bracket tab and said slide tab being spaced apart from each other when said slide is in said locked position to present a gap therebetween, said slide tab including a shroud member extending generally across said gap.

9. A lightweight, synthetic resin shelf member for storing articles, said shelf member being adapted for mounting within a generally upright frame, comprising:

a top surface having a leading edge and a back portion, said top surface including structure defining an elongated groove extending generally between said leading edge and said back portion, said groove having a groove bottom wall and opposed groove sidewalls;

a bottom surface having a face spaced apart from said top surface, and structure defining a recess extending inwardly from said bottom surface face, said recess including a recess top wall, recess front wall, recess rear wall, and opposed recess sidewalls, said recess being generally aligned with said top surface groove and said recess top wall being melded with said top surface groove bottom wall, whereby the melding of said recess top wall and said groove bottom wall provides strength to said shelf member, and the fore and aft orientation of said groove facilitates entry and egress of articles from said shelf member; and a downwardly extending peripheral rim extending generally around said bottom surface adapted for receiving a retaining bracket for mounting of said shelf member within said generally upright frame.

10. The invention as claimed in claim 6 or 9, said bottom surface including a back edge, said peripheral rim including structure defining bracket receiving notches along said back edge for slidable acceptance of said brackets by said rim.

* * * * *